US005494505A

United States Patent [19]

Tomioka et al.

[11] Patent Number: 5,494,505

[45] Date of Patent: Feb. 27, 1996

[54] COMPOSITE PLATING COATINGS

[75] Inventors: Toshikazu Tomioka, Ibaraki; Katsumi Tomita, Hirakata; Masaaki Yonemura, Nara, all of Japan

[73] Assignee: Matsushita Electric Industrial Co., Ltd., Osaka, Japan

[21] Appl. No.: 379,093

[22] Filed: Jan. 26, 1995

Related U.S. Application Data

[63] Continuation of Ser. No. 72,550, Jun. 4, 1993, abandoned.

[30] Foreign Application Priority Data

Jun. 5, 1992 [JP] Japan ..... 4-145466
Jun. 5, 1992 [JP] Japan ..... 4-145467
Jun. 5, 1992 [JP] Japan ..... 4-145468

[51] Int. Cl.[6] ..... C09D 5/00

[52] U.S. Cl. ..... 106/15.05; 106/1.22; 106/1.25; 106/1.29; 106/18.36; 205/80; 205/261; 205/271

[58] Field of Search ..... 106/1.22, 1.25, 106/1.29, 15.05, 18.36; 148/22; 205/80, 261, 271; 428/544, 615, 621, 624; 523/122; 514/618, 619, 641, 630

[56] References Cited

U.S. PATENT DOCUMENTS 3,006,822 10/1961 Todt ..... 205/271
4,190,514 2/1980 Matsuura et al. ..... 205/271
4,222,828 9/1980 Zuurdeeg ..... 204/16
4,368,223 1/1983 Kobayashi et al. ..... 106/1.22
4,371,573 2/1983 Januschkowetz et al. ..... 106/1.22
4,470,897 9/1984 Iezzi et al. ..... 204/432
4,549,942 10/1985 Tremmel et al. ..... 205/271
4,582,576 4/1986 Opaskar et al. ..... 106/1.25
4,880,464 11/1989 Ushio et al. ..... 106/1.05
4,956,014 9/1990 Kondo et al. ..... 106/1.05
5,116,430 5/1992 Hirai et al. ..... 148/518
5,145,517 9/1992 Feldstein et al. ..... 106/1.05
5,262,466 11/1993 Baldi ..... 524/430

FOREIGN PATENT DOCUMENTS 64-297 1/1989 Japan .

OTHER PUBLICATIONS

Fransaer J., Celis J. P., and Roos J. R., "Metal–Liquid Composite Coatings", *Metal Finishing No. 6*, pp. 107–109, Jun. (1989).

*Primary Examiner*—Anthony Green
*Attorney, Agent, or Firm*—Ratner & Prestia

[57] ABSTRACT

A composite plating coating includes a metal plating coating which is dispersed with an antibacterial and antifungal composition and/or a fragrant composition. Particularly, by dispersing carriers absorbed with an antibacterial and antifungal composition and a fragrant composition in a metal plating coating, a composite plating coating with an antibacterial and antifungal effect and a fragrance effect can be obtained.

18 Claims, 1 Drawing Sheet

COMPOSITE PLATING COATINGS

This application is a continuation of application Ser. No. 08/072,550 filed Jun. 4, 1993, abandoned.

II. FIELD OF THE INVENTION

The present invention relates to composite plating coatings having antibacterial and antifungal characteristics.

III. BACKGROUND OF THE INVENTION

Several composite plating coatings are already known including one prepared by dispersing pigments in a metal for coloring and another prepared by dispersing ceramic particles or graphite particles in a metal to improve wear-resistance, heat resistance and lubricating effects. Materials such as steel sheets, with surfaces covered by composite plating coatings are widely used in kitchen wares, furniture, walls of houses, automobiles, etc.

In recent years, more attention has been paid to the adverse effects to human beings caused by the generation of bad smells due to the proliferation of various bacteria in areas such as kitchen sinks which require hygienic caution. Attention has also been paid to human contamination and stained appearances on painted wall materials due to mold growth.

IV. SUMMARY OF THE INVENTION

A composite plating coating comprised of metallic plating layers wherein particles having at least either an antibacterial and antifungal composition or a fragrant composition are dispersed. When the composite plating coatings of the antibacterial and antifungal composition are used with articles such as a kitchen sink in which various types of bacteria proliferate and bad smells are likely to be emitted, the aforementioned adverse effects may be suppressed by the antibacterial and antifungal composition. Also, the composite plating coatings containing a fragrant composition will make it possible to mitigate bad smells and emit a pleasant odor.

In addition, by adding pigments to the foregoing composite plating coatings, it becomes possible to provide coloring to the articles in which the plating coatings are used.

Further, by adding a fluorine compound such as polytetrafluoroethylene to the aforementioned coatings, it becomes possible to provide coatings with water and oil repellent capabilities. Accordingly, when the above particular coatings are applied to a garbage basket installed at one corner of a kitchen sink, for instance, sewage and oil will barely adhere to the garbage basket. As a result, sources for nurturing various bacteria are shut off restraining the proliferation of the bacteria.

The foregoing particles of the antibacterial and antifungal composition and the fragrance emitting composition should preferably be dispersed in the metallic plating layers after the surfaces thereof have been covered by resin. Since the antibacterial and antifungal composition and the fragrant composition are released gradually through the resin, the effects thereof can be prolonged. In addition, particles prepared by first mulling an antibacterial and antifungal composition and a fragrant composition with resin (instead of coating them with resin) and then pulverizing the mulled composition present the same effects.

Furthermore, when the composite plating coatings are exposed to an outside force (i.e. touching by hand), micro-capsules with particles having the antibacterial and antifungal composition and the fragrant composition may be used by dispersion in the metallic plating layers. In this case, every time an external force is applied, the micro-capsules are slowly destroyed releasing the antibacterial and antifungal composition and the fragrant composition, resulting in a sustained releases of the above compositions.

In addition, the antibacterial and antifungal composition and the fragrant composition may be in carriers formed of a porous material and then these carriers can be dispersed in the composite plating coatings. In this case, even when a great amount of the antibacterial and antifungal composition and the fragrant composition is absorbed, releasing thereof will not take place at one time, but will be prolonged with a resulting excellent continuation of release.

V. BRIEF DESCRIPTION OF THE DRAWINGS

VI. DETAILED DESCRIPTION OF THE INVENTION

Figure 1:
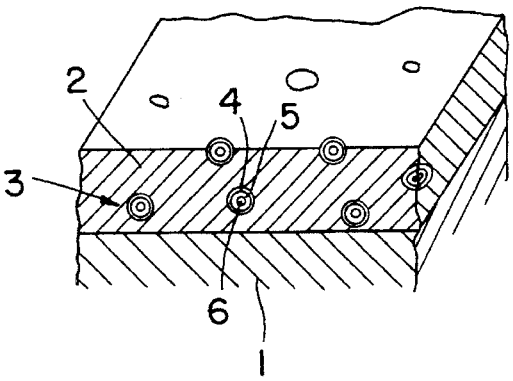
FIG. 1 is a schematic illustration to show the structure of a portion of a first exemplary embodiment of the present invention's composite plating coatings.

The antibacterial and antifungal composition that can be used in the present invention's composite plating coatings may include any of several inorganic substances such as metal salt, metal complex salt, chloride, iodide, boric acid, sulfur, calcium oxide, etc., organic substances such as saturated aldehyde, unsaturated ether, quarternary ammonium salt, amino acid derivative, guanidine derivative, thiabendazole, biguanite, etc., natural products such as hinokitiol, cinnamon oil, Japanese horse radish ("wasabi") oil, etc. The appropriate composition is selected in accordance with the particular application.

Among the aforementioned antibacterial and antifungal compositions, the inorganic compositions excel in retentiveness. Particularly, metal salt of silver, copper or zinc and metal complex salt of these metals excel in sterilizing power and have little poisonous effect. Therefore, these inorganic antibacterial and antifungal compositions are suitable for use, for example, in kitchen wares.

Since the volatility of an organic antibacterial and antifungal composition is great, the retentiveness of its effects are not prolonged. However, its sterilizing power is strong. Therefore, the organic antibacterial and antifungal composition is suitable for use with air filters, wall materials or the like. Particularly, quarternary ammonium salt, thiabendazole and biguanite are well suited for the foregoing applications.

In order to enhance the retentiveness of the antibacterial and antifungal action, the coating resin to cover the antibacterial and antifungal composition should pass the composition little by little. Polystyrene and polymethacrylate are particularly suited for this purpose. In addition, these kinds of resins are quite suitable for mulling with the antibacterial and antifungal composition.

An inorganic material such as silicon dioxide or titanium dioxide is used as an encapsulating material for a microcapsule wherein the antibacterial and antifungal composition forms a core. These materials have moderate permeability and are suited for retaining the antibacterial and antifungal effects. However, a resin showing moderate permeability against the antibacterial and antifungal composition can be used as the encapsulating material in place of the inorganic material.

A porous material that can absorb a great amount of the antibacterial and antifungal composition is quite suited as the carrier where the antibacterial and antifungal composition is absorbed. Specifically speaking, silica gel, zeolite, montmorillonite and the like are quite suited for that purpose.

The fragrant composition that can be used in the present invention's composite plating coatings includes natural fragrant substances consisting of vegetable fragrant substances extracted from rose, grove, lemon, cardamom, sandal-wood, etc., and animal fragrant substances taken from musk, civet, etc., and also various artificial fragrant substances. The most appropriate ones need to be selected from the foregoing in accordance with the particular application. In order to prolong retention of fragrance emitted from the composite plating coatings, dispersion into the metal plating layers is preferably performed using the same means which is employed with the antibacterial and antifungal composition such as resin coating, mulling with resin powder, microcapsulating and carrier absorbing. The materials for the resin coating, the carrier or the like can be the same as in the case of the antibacterial and antifungal composition.

In preparing the present invention's composite plating coatings, appropriate materials are selected so that the antibacterial and antifungal composition is only dispersed, the fragrant composition is only dispersed or both of these are dispersed, depending on the intended application. The antibacterial and antifungal composition tends to emit unpleasant smells. However, by dispersing a fragrant composition together with the antibacterial and antifungal composition, bad smells can be mitigated. When both the antibacterial and antifungal composition and the fragrant composition are dispersed into the metal plating, each respective composition should preferably be provided in the similar form. When the antibacterial and antifungal composition is resin coated, for example, the fragrant composition is also resin coated. When these compositions are dispersed in the same configuration, an uneven distribution of both compositions in the metal plating layers can be prevented by using a composite plating coating which has both compositions uniformly dispersed.

The appropriate amount of the antibacterial and antifungal composition and the fragrant composition to be dispersed into the metal plating layers can be adjusted to between amounts where the antibacterial and antifungal effect or the fragrance becomes apparent and the amount where the inherent characteristics of the metal plating layers (such as mechanical strength) become obscure. The range of the foregoing amounts is dependent on the types of antibacterial and antifungal composition and the fragrant compositions and also the specifications for the products in which these compositions are used. In the case of kitchen ware in which silver complex salt is used as the antibacterial and antifungal composition, for example, an antibacterial and antifungal composition ranging from 0.1 to 5 weight % should preferably account for a nickel plating layer which is set as 100 weight %.

As stated before, pigments and fluorine compounds can be added to prepare the present invention's composite plating coatings. The pigments to be added can be inorganic pigments such as titanium dioxide, zinc oxide, etc., and organic pigments such as phthalocyanine, etc. The configuration of the pigments to be added should be preferably the same as the configuration of the antibacterial and antifungal composition and the fragrant composition for a homogeneous dispersion in the metal plating layers.

The fluorine compounds to be added should preferably be fluorinated graphite particles, polytetrafluorethylene (PTFE) particles or the like. In particular, a composite plating coating dispersed with denatured PTFE particles is excellent in terms of a water and oil repellent capability and also wear resistance. The amount of the fluorine compounds to be added is dependent on the specifications for the products for which the coating is used. The amount ranges from 5% to 50% by weight to maintain a good water repellent capability.

Some of the exemplary embodiments of the present invention will be described in the following:

EXAMPLE 1

Silver thiosulfate complex salt serving as an antibacterial and antifungal composition was absorbed by silica gel acting as a carrier. The silica gel was then coated with a substance obtained from hydrolysis of tetraethoxysilane and was then further coated with polystyrene resin to form a resin coating. The resultant product having an antibacterial and antifungal composition was dispersed into a matrix of a nickel plating layer.

More specifically, the above product having an antibacterial and antifungal composition and having a particle diameter measuring 3 μm (1 μm as the thickness of polystyrene coating) was placed in suspension in a cationic surfactant and then added to a nickel sulfamate bath at an amount of 100 g/l. Plating on an iron sheet was then conducted at an ordinary voltage. A composite plating coating of nickel and an antibacterial and antifungal composition with a thickness of 10 μm was formed with a two weight % inorganic antibacterial and antifungal composition contained in a eutectic state.

FIG. 1 shows a schematic illustration of the structure of the obtained composite plating coating with an antibacterial and antifungal capability. Item 1 is an iron sheet forming a base material and its surface is coated by a matrix 2 of nickel plating. Resin coated particles 3 of inorganic antibacterial and antifungal composition are scattered in the matrix 2. The internal structure of each individual resin coated particle 3 consists of a polystyrene resin coating 4 situated in the exterior, a coating 5 of a substance produced by hydrolysis of tetraethoxysilane in the middle layer and silica gel 6 carrying silver thiosulfate complex salt in the core.

The foregoing antibacterial and antifungal composite plating coating was subjected to an antifungal test and an antibacterial test according to the Japan Industrial Standards (JIS-Z-2911).

The fungi used in the antifungal test were *Cladospolium cladosporioides, Chaetomium globosmand* and *Penicillium citrium*. Aspergillus niger and halo tests were conducted after 14 days to evaluate the results.

The bacteria used in the antibacterial test were *Escherichia coli, Staphyrococcus aureus* and *Bacillus subtilis* and the results were evaluated after 7 days.

As a result, it was observed that halos of more than 2 mm were grown on a mixture of the foregoing four kinds of fungi, *Escherichia coli* and *Staphyrococcus aureus*. No growth of halos was observed on *Bacillus subtilis* and no proliferation of bacteria was observed on the antibacterial and antifungal composite plating coating.

In order to evaluate durability, the coating was immersed in warm water of 65° C. for one month and then the same tests were performed. Results identical to the previous results were obtained.

The amount of silver ions dissolved was measured at the initial period and also during the course of one month in a shaker. The results showed that the dissolving amount of silver ions ranged from 104 to 87% of that of the initial period during the course of one month in a shaker. This amount decreased slightly in the initial period but after that period the silver ion density was constant. This indicated that a very slow reaction was taking place.

Accordingly, it is known that the antibacterial and antifungal effect was maintained over a long period as is seen from the amount of silver which dissolved. When new scars are inflicted upon the surface of a composite plating coating, the amount of silver dissolving may increase somewhat as a result of exposure of the resin coated particles 3 of the inorganic antibacterial and antifungal composition located at the scars. In practice, countless scars are made and new resin coated particles 3 are exposed constantly resulting in a continuation of a renewed antibacterial and antifungal effect over a long period of time in addition to the gradual releases.

An electroplating was performed in a nickel sulfamate bath with this particular example, however, a Watt's nickel plating bath for the antibacterial and antifungal composition was likewise able to be created eutecticly. Furthermore, the resulting composition had an effect which was equal to that of the composition created in the nickel sulfamate bath. Also, by having the antibacterial and antifungal composition mixed into an electroless plating solution to form a composite plating coating, it was possible to form a composite plating coating of almost the same content of the antibacterial and antifungal composition as that of the present example by controlling the addition of the antibacterial and antifungal composition. Besides, by increasing the amount of the antibacterial and antifungal composition in suspension in the plating solution, it is possible to increase the resultant amount of the antibacterial and antifungal composition contained in the composite plating coating. With only a few percent or less of the antibacterial and antifungal composition the plating bath, a sufficient antibacterial and antifungal effect can be gained.

In addition, an inorganic antibacterial and antifungal composition carried by silver thiosulfate complex salt was used in the present example but the amount to form a composition is limited to some extent in the dispersing process of the inorganic antibacterial and antifungal composition into the metal plating coating since the thickness thereof is around 10 μm. Therefore, for a lasting antibacterial and antifungal effect, it is necessary to have the silver complex salt carried by silica gel in a high concentration and to make the silver ions dissolve at a stable rate, e.g. to realize a gradual releasing action. In other words, the carried silver complex salt penetrates the resin layer and dissolves as silver ions at the surface of the resin layer causing the antibacterial and antifungal effect. By having a resin coating formed on the surface of silica gel, an inclination in the silver concentration can be created in the resin coating to make it possible to control the amount of silver ions which dissolve. Therefore, even with the silver complex salt carried by silica gel in a high concentration, silver will not dissolve in a great amount during the initial period and a stable and gradual release of silver ions over a long period can be achieved with a resultant performance of a stable and lasting antibacterial and antifungal effect.

EXAMPLE 2

Figure 2:
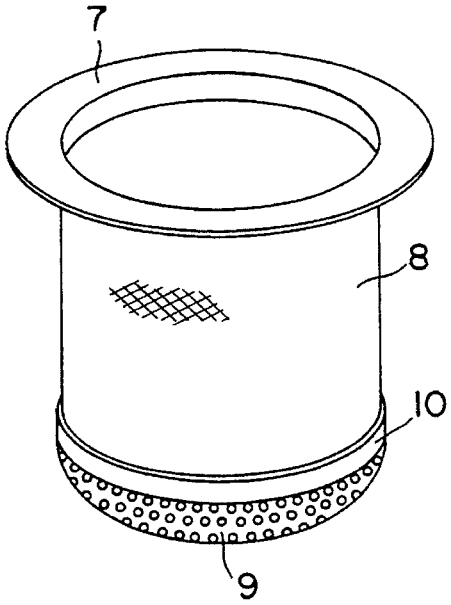
FIG. 2 is a perspective view of a garbage basket applied with a composite plating coating as described in a second exemplary embodiment of the present invention.

A case where a composite plating coating was applied to a garbage basket installed in a kitchen sink will be described in the following:

FIG. 2 is a perspective view of a garbage basket consisting of a ring like metal flange 7, a cylindrical metal cage 8 fixed thereto, a dome shaped bottom plate 9 with many water passing holes and a fixing metal 10 to put together the metal cage 8 and the bottom plate 9. All of the above components are preferably made of stainless steel.

A composite nickel plating was applied to the garbage basket by use of a nickel sulfamate bath wherein a fluorine compound and an inorganic antibacterial and antifungal material were dispersed in suspension. Particles of denatured polytetrafluoroethylene (PTFE) as the fluoride, measuring 0.17 μm in average diameter were dispersed in suspension in the plating solution. Silver thiosulfate complex salt carried by silica gel of 3 μm in diameter was used as the antibacterial and antifungal composition. The plating thickness was 10 μm and the garbage basket was subjected to a heat treatment at 180° C. after plating. In the plating coating were included 13 weight % of denatured PTFE and 0.2 weight % of silica gel carrying the antibacterial and antifungal material.

Figure 3:
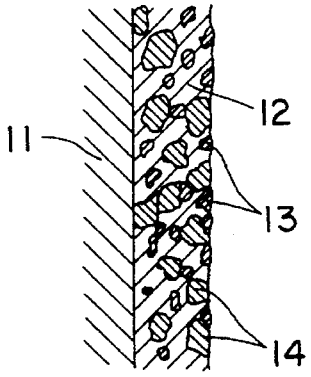
FIG. 3 is a cross-sectional illustration to show the structure of a portion of the composite plating coating.

FIG. 3 is a cross-sectional magnified illustration of a portion of the plating coating. Item 11 is a stainless steel structure used as a basic material of the garbage basket, item 12 is a nickel plating coating applied to the surface of the stainless steel. The plating coating has dispersed particles of denatured PTFE 13 and silica gel particles 14 carrying the antibacterial and antifungal material. These denatured PTFE particles 13 and the silica gel particles 14 are firmly held in the plating coating 12 by an anchor effect.

The garbage basket thus prepared is provided with a water and oil repellent capability on account of the PTFE particles 13 dispersed near the surface of the nickel plating coating 12. It also has a coefficient of friction which is extremely small. In addition, its resistance to mechanical wear is high and use of a brush or a sponge for cleaning will not hurt the basket by causing peeling of the coating that can be often experienced with PTFE coated materials generally used. It has been determined that the garbage basket is strong enough to be used over a long period.

When a garbage basket is coated with fluorocarbon polymer, the coating strength is too small to withstand rubbing by a brush for cleaning and the basket does not satisfy durability requirements. Besides, the coating thickness is too large and the water flow through the spacing of the cage or the holes of the bottom plate becomes blocked, rendering the basket useless for its intended purpose, namely for separating water from garbage. In contrast, when the exemplary embodiment of the present invention is used as a plating coating, the thickness of the coating is maintained over the surface of the garbage basket so that the antibacterial and antifungal effect exists and passing of water through the spacings and the holes is not blocked. Thus, the separation of water from garbage is efficiently and reliably performed.

Observations of the garbage basket thus prepared revealed that a separation of water from garbage was performed effectively without garbage (such as used tea leaves) sticking to the upper areas of the cage 8 and without plugging of the spacing thereof on account of the low coefficient of friction presented by the surface coating of the cage. Thus, no deterioration in the water separating action resulted. Besides, water and oil did not stay on the surface of the garbage basket due to a water and oil repellent capability of the coating applied to the garbage basket.

Furthermore, there was no sliminess on the surface of the garbage basket because the silver thiosulfate complex salt served as an antibacterial and antifungal material to suppress the proliferation of bacteria and fungi.

Also, when remains of the garbage left in the bottom portion of the garbage basket were discarded, the remains were easily taken out just by turning the garbage basket upside down since the garbage did not sticking to the surface of the garbage basket because of of its low coefficient of friction and its water and oil repellent capability. An observation of the garbage basket after it was emptied indicated no sliminess or sticking of dirt even at the places which had been in contact with piled garbage for some period. It was learned from this result that the denatured PTFE particles and the silver thiosulfate complex salt carried by silica gel were functioning well.

Since the inorganic antibacterial and antifungal material of silver thiosulfate complex salt carried by silica gel as used in the present example is a colorless powder, the color of nickel plating can be maintained as is. Silver carrying zeolite can be used as another antibacterial and antifungal material. In this case, its content in the plating coating needs to be 0.6 weight % to maintain the antibacterial and antifungal effect.

EXAMPLE 3

A nickel electroless plating using silica gel that carried the same fluorine compound and antibacterial and antifungal material as was used in Example 2 was applied to the surface of a flat-bottomed cylindrical garbage basket made of resin by a resin molding process. There were many holes of 1.5 mm in diameter on the bottom and side walls measuring 2 to 3 mm in thickness of the garbage basket for passing water.

When resin is coated to cover the surface of such a garbage basket as above, it is difficult to have the inside of the holes coated by resin since the resin tends to stay near the edges of the holes to form a thick mound. This hinders the resin from extending to the inside walls of the holes and from coating the holes. In contrast, the electroless plating employed in the present example made it possible to have the coating material extended into the inside of the holes with a sufficient plating thickness. It is usually very difficult to clean the inside walls of the holes of a garbage basket having a fairly thick structure. Therefore, fungi and bacteria tend to proliferate there and also slime and dirt collect there. However, by having a fluorine compound and an antibacterial and antifungal composition dispersed in a composite plating coating to be applied over the surface of a garbage basket, proliferation of fungi and bacteria can be prevented and the collection of slime and dirt can be suppressed. Also, the garbage basket thus prepared can be cleaned readily by washing off the slime and dirt.

EXAMPLE 4

By means of a hybridization method whereby finely powdered silica was attached around a fragrant composition, micro-capsules having a fragrant composition, as a core were prepared. A vegetable aromatic essence of rose was used as the fragrant composition.

A plating was applied to the surface of a base material of stainless steel (SUS304) under the condition of $_p$H4.2, 50° C. and 2 A/dm$^2$ in a plating bath prepared by dispersing 100 g/l of micro-capsules, each measuring about 0.5 μm in diameter, into a Watt's bath consisting of 280 g/l of nickel sulfate, 45 g/l of nickel chloride and 40 g/l of boric acid.

Through an application of an external force, such as rubbing with a finger on the plating layer, a portion of the micro-capsule was destroyed and the fragrant material within the capsule was released through the partially ruptured layer to the outside.

Besides, when the amount of the micro-capsules dispersed into the plating bath ranged from 1 to 500 g/l, appropriate fragrance was maintained without damaging the strength of the plating layer.

EXAMPLE 5

The same fragrant material as used in Example 4 was absorbed in silica gel of 1 μm in diameter serving as a carrier.

Then, a plating was performed under the same condition as that of Example 4 in a plating bath prepared by dispersing 1.5 g/l of saccharin, 0.2 g/l of 2-Buten-1, 4-diol serving as a glazing material, 100 g/l of perfluoralkyle ethylene oxide condensation product serving as a nonionic fluorine surfactant and 100 g/l of a carrier of silica gel that absorbed the fragrant composition.

The surface of the foregoing plating coating emitted fragrance while maintaining its repellency and slipperiness.

EXAMPLE 6

A solution prepared by mixing 3 parts by weight of cinnamon oil according to the prescription of the Japanese Pharmacopoeia with 100 parts of weight of a solvent such as ethyl alcohol or methyl alcohol was mixed by dispersion with 100 parts by weight of B type silica gel as defined in the Japanese Industrial Standards. The mixture was then quickly dried. Then, the above product was heated to a temperature which is a little higher than the boiling temperature of the solvent used to evaporate the solvent and water contained in the product and then crushed to obtain particles of a desired size to obtain an antibacterial and antifungal material.

Next, by means of a so called hybridization method whereby finely powdered silica is attached around a fragrant material extracted from rose, micro-capsules having the fragrant material as a core were prepared.

A plating was applied to the surface of a base material of stainless steel (SUS304) under the condition of $_p$H4.2, 50° C. and 2 A/dm$^2$ in a plating bath prepared by dispersing 100 g/l of the foregoing antibacterial and antifungal composite material measuring 0.5 μm in diameter and 100 g/l of micro-capsules into Watt's bath consisting of 280 g/l of nickel sulfate, 45 g/l of nickel chloride and 40 g/l of boric acid.

The same antibacterial and antifungal tests as conducted in Example 1 were performed on the obtained composite plating coating. The test results showed that haloes of more than 10 mm were grown in the case of *Escherichia coli* and halos of more than 2 mm were grown in the case of *Staphyrococcus aureus* and a mixture of four kinds of fungi. In the case of *Bacillus subtilis*, neither a growth of halos nor a proliferation of bacteria were observed.

Through the application of an external force, such as rubbing by a finger, to the plating layer, a portion of the micro-capsule was destroyed and the fragrant material within the capsule was released through the partially ruptured layer to outside. Although the antibacterial and antifungal material had a peculiar odor, the odor was masked by the fragrance emitted from the fragrant material. Consequently, the composite plating coating was exercising an antibacterial and antifungal effect while emitting fragrance.

EXAMPLE 7

A material formed of silica gel measuring about 1 μm in diameter and having the fragrant material described in Example 6 absorbed therein and carried thereby was prepared. Also, an antibacterial and antifungal composite material was prepared in the same way as described in Example 6 except that the cinnamon oil according to the prescription of the Japanese Pharmacopoeia was replaced by allyl isothiocyanate.

Next, into the same Watt's bath as used in Example 6 were dispersed 1.5 g/l of saccharin, a glazing material consisting of 0.2 g/l of 2-Buten-1, 4-diol, 100 g/l of a nonionic fluorine surfactant of perfluoroalkyle ethylene oxide condensation product and 100 g/l of a carrier of silica gel that absorbed and carried the aforementioned fragrant material and then a plating was performed under the same condition as that of Example 6.

The surface of the plating coating thus formed emitted fragrance and exercised an antibacterial and antifungal effect while maintaining its repellency and slipperiness. Although the antibacterial and antifungal material had a peculiar odor, the odor was masked by the fragrance emitted from the fragrant material. With regard to the antibacterial and antifungal effect tests, the same results were obtained as in Example 6.

EXAMPLE 8

Micro-capsules were prepared by attaching titanium oxide around a mica particle serving as a pigment by means of a hybridization method. These micro-capsules with cores consisting of pigment were added to the Watt's bath of Example 6 by an amount of 100 g/l and a composite plating coating was formed having an antibacterial and antifungal composite material, micro-capsules with cores of fragrant composition and micro-capsules with cores of pigment dispersed in a nickel layer according to the same method as used in Example 6. This composite plating coating showed a glossy pearl-white color of brilliant coloring while exercising an antibacterial and antifungal effect and emitting fragrance.

Eight specific cases of the present invention's exemplary embodiments were described in the foregoing, however, the present invention is not limited in its embodiments to the foregoing examples. As an example of a metal coating as the composite plating coating, a case wherein a nickel coating was formed was described. However, a coating of other metals than nickel, such as cobalt, copper, zinc, lead, tin, silver, and an alloy coating of these metals are encompassed by the present invention. In addition, a great variety of combinations of antibacterial and antifungal compositions, fragrant compositions and pigments are encompassed by the present invention.

Also, the application of the composite plating coatings disclosed by the present invention is not limited only to the garbage basket installed in a kitchen sink as exemplified in the foregoing. A great variety of products such as other kitchen wares, furniture, construction materials, automobiles and the like may be used.

What is claimed:

1. A composite plating coating composition comprising:

a metal matrix, having dispersed therein an effective antibacterial and antifungal amount of an antibacterial and antifungal substance selected from the group consisting of silver salt, silver complex salt, zinc salt, zinc complex salt and copper complex salt.

2. The composite plating coating composition according to claim 1, wherein a color pigment is also dispersed in said metal matrix.

3. The composite plating coating composition according to claim 1, further including a repellent compound including fluorine dispersed in said metal matrix.

4. The composite plating coating composition of claim 1 including a fragrant substance added thereto.

5. A composite plating coating composition comprising:

a metal matrix, having dispersed therein an effective antibacterial and antifungal amount of an antibacterial and antifungal substance coated with a resin to enhance retentiveness of antibacterial and antifungal properties of said antibacterial and antifungal substance.

6. The composite plating coating composition of claim 5, wherein said resin is selected from the group consisting of polystyrene and polymethacrylate.

7. The composite plating coating composition of claim 5, including an effective fragrant amount of a fragrant composition added thereto.

8. The composite plating coating composition of claim 7, wherein the fragrant substance is coated with a resin to prolong retention of the fragrant substance.

9. A composite plating coating composition comprising:

a metal matrix, having dispersed therein an effective antibacterial and antifungal amount of an antibacterial and antifungal substance encapsulated into microcapsules.

10. The composite plating coating composition of claim 9, wherein the encapsulating material is selected from the group consisting of silicon dioxide, titanium dioxide and a resin exhibiting moderate permeability for the antibacterial and antifungal substance.

11. The composite plating coating composition of claim 9, including an effective fragrant amount of a fragrant composition added thereto.

12. The composite plating coating composition of claim 11, wherein the fragrant substance is encapsulated into micro-capsules.

13. A composite plating coating composition comprising:

a metal matrix, having dispersed therein an effective antibacterial and antifungal amount of an antibacterial and antifungal substance absorbed in a porous carrier.

14. The composite plating coating composition of claim 13, wherein the porous carrier is selected from the group consisting of silica gel, zeolite and montmorillonite.

15. The composite plating coating composition of claim 13, including an effective fragrant amount of a fragrant composition added thereto.

16. The composite plating coating composition of claim 15, wherein the fragrant substance is absorbed in a porous carrier.

17. A composite plating coating composition comprising 0.1 to 5% by weight of silver complex salt in a nickel matrix.

18. A composite plating coating composition comprising 13% by weight denatured polytetrafluoroethylene and 0.2% by weight silica gel in a nickel matrix, said silica gel including an effective antibacterial and antifungal amount of an antibacterial and antifungal substance.

* * * * *